US005390607A

United States Patent [19]

Lydic

[11] Patent Number: 5,390,607

[45] Date of Patent: Feb. 21, 1995

[54] NON-METALLIC POLYMER LONGITUDINAL HOOD COLLAR

[75] Inventor: Todd Lydic, Johnstown, Pa.

[73] Assignee: Johnstown America Corporation, Chicago, Ill.

[21] Appl. No.: 176,661

[22] Filed: Jan. 3, 1994

[51] Int. Cl.[6] ..... B61D 7/02

[52] U.S. Cl. ..... 105/247; 105/424

[58] Field of Search ..... 105/247, 248, 416, 423, 105/424

[56] References Cited

U.S. PATENT DOCUMENTS 3,538,857 11/1970 Mowatt-Larssen ..... 105/247

4,455,947 6/1984 Reeve et al. ..... 105/424 X 4,493,266 1/1985 Augustine ..... 105/255

4,497,258 2/1985 Ruhmann et al. ..... 105/424 X 4,884,511 12/1989 Hallam ..... 105/247

5,311,823 5/1994 Rudibaugh et al. ..... 105/404 X

*Primary Examiner*—Robert J. Oberleitner

*Assistant Examiner*—S. Joseph Morano

[57] ABSTRACT

A hood collar for connecting and sealing the end of a center sill hood on a sloped floor sheet of a hopper rail car. The hood is formed from a polymer material and has a slot for receiving the end of hood. The collar is formed with flanges that are attached by mechanical fasteners to the floor sheets.

15 Claims, 4 Drawing Sheets

NON-METALLIC POLYMER LONGITUDINAL HOOD COLLAR

BACKGROUND OF THE INVENTION

1. Field of the Invention

This invention relates in general to rail hopper cars and, more specifically, to longitudinal hood collars.

2. Summary of the Prior Art

Hopper rail cars have long been used to transport particulate material, such as coal, gravel, grain, pressed stone, and the like. In recent years, hopper cars have been made of aluminum and use a steel center sill as a major structural element. The center sill extends from end to end and primarily transmits draft and buff loads through the car. In such hopper cars, it is common to protect the steel center sill from corrosion from the particulate material by using a longitudinal hood made of aluminum. The longitudinal hood intersects the lower portion of the hopper floor sheets at chute locations and the sloped hopper end walls. As a result, a connection is required between the longitudinal hood protecting the center sill and the hopper floor sheets and end walls to insure that lading does not pass between the hood and the floor sheet and come in contact with the steel center sill.

A sealed connection between the hood and floor sheets have in the past been provided by metal-formed or cast collars. Such metal collars are typically rigidly affixed to both the hood and the floor sheets and much of the applied loads due to draft and buff loads are transmitted through the hood member from the center sill to the floor sheet. As a result, high stress points are created in the hood collar from the draft and buff loads which in effect are pulling the longitudinal hood away from the floor sheet. Because of these stress points in prior designs of collars, the connection is subject to cracking and failure of the mechanical fastener. An example of a known aluminum hood collar is disclosed in U.S. Pat. No. 4,884,511 to Hallam et al.

Metallic collars, being rigid in structure, also do not readily conform to varying cross sections of the hood which can cause gaps between the hood and hopper chutes to reduce the effectiveness of the seal. Moreover, the rigidity of known collars do not provide flexibly to conform to variations in cross sections of particular longitudinal hoods. Accordingly, improvements are needed in the design and construction of hood collars for use in railway hopper cars.

SUMMARY OF THE INVENTION

It is therefore an objective of the invention to provide an improved collar for the longitudinal hood covering the center sill of a hopper car. The hood of the invention is constructed from a relatively flexible non-metallic polymer material that can easily conform to varying cross sections of the longitudinal hood. The collar of the invention includes a female portion designed to receive an end of the hood in a sliding fit. The collar is then only attached rigidly to the hopper floor sheets. As a result the hood collar is not rigidly attached to the center sill, and draft and buff forces are not transmitted from the center sill to the hopper sheets which create high stress areas in prior collar designs. The polymer material used in the collar of the application is highly resistant to corrosion and is suitably flexible to allow attachment to a range of various variations of cross section in the hood. Such flexibility reduces the problems in connecting a longitudinal hood to a metal collar as previously encountered. In addition, the female portion of the collar permits the longitudinal hood length to vary slightly without creating gaps between the hood and hopper chutes. The collar of the invention thus attains a better seal between the longitudinal hood and sloped hopper chutes as opposed to prior art metallic collars in which the longitudinal hood length has to be very accurate to attain a proper fit with the hopper floor sheets.

DESCRIPTION OF THE PREFERRED EMBODIMENT

Figure 1:
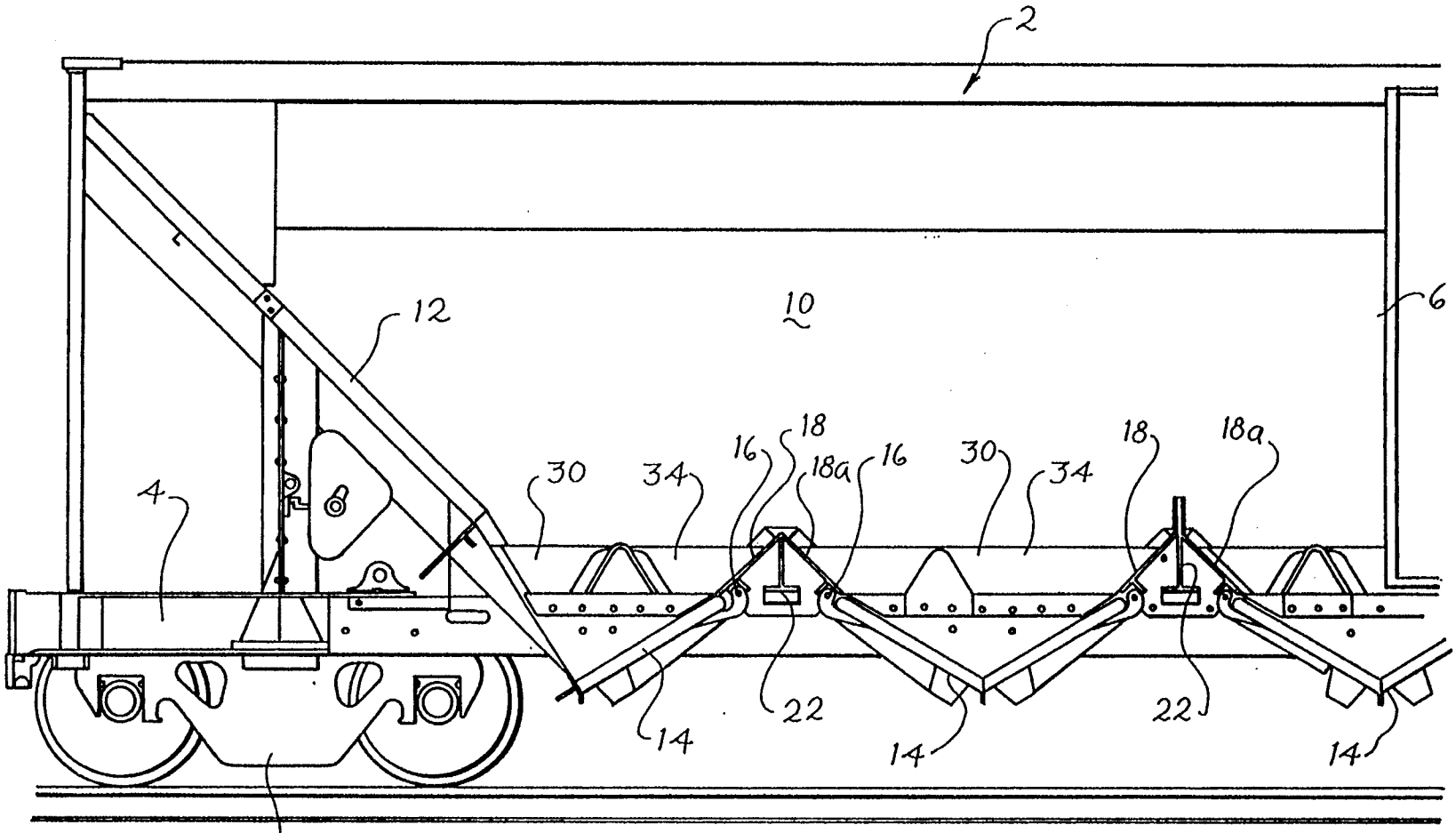
FIG. 1 is a partial side elevational view, with parts removed, of a hopper car having the non-metallic polymer longitudinal hood collar of the invention.

Referring now to FIG. 1 there is illustrated a railway hopper car, generally designated by reference number 2, for transporting aggregate materials. The hopper car 2 includes a center sill 4 extending longitudinally from end to end of hopper car 2 and having a generally box shaped design. The center sill 4 is mounted beneath a hopper car body 6 which is supported at each end by conventional truck assemblies 8. The car body 6 has opposing vertical aluminum sidewalls 10 (one of which is shown in FIG. 1) and sloped end walls or sheets 12 (one of which is shown on FIG. 1). The hopper body 6 is designed to transport aggregate materials that are discharged by gravity through pivotally mounted doors or gates 14 located along the bottom of car at a plurality of locations, such as five in number. The doors 14 are conventional in design and are pivotally coupled to the car body by hinge member 16. The doors 14 are operated by known dump mechanism and function to rotate in unison when being opened in opposite directions.

Figure 2:
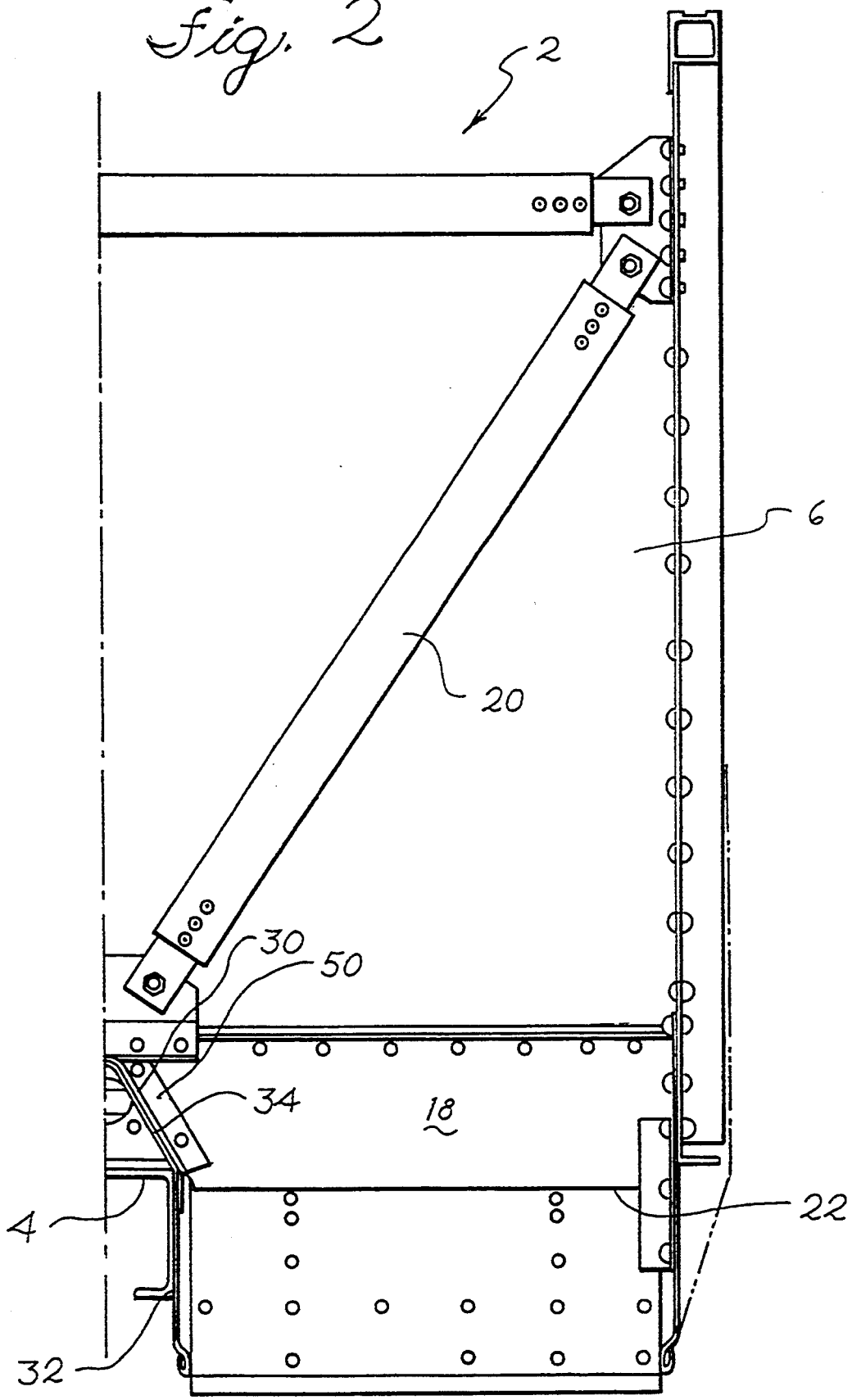
FIG. 2 is a partial end elevational view, with parts removed, of the hopper car of FIG. 1 having the non-metallic polymer longitudinal hood collar.
Figure 4:
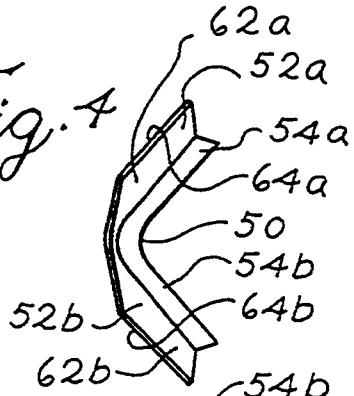
FIG. 4 is an end elevational view rotated 90 degrees of the non-metallic polymer longitudinal hood collar of the invention.
Figure 5:
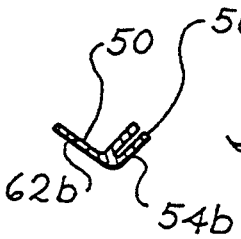
FIG. 5 is a sectional view taken along line 5—5 of FIG. 6 of the female portion of the non-metallic polymer longitudinal hood collar of the invention.
Figure 6:
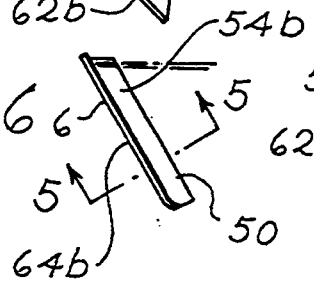
FIG. 6 is an end elevational view of the non-metallic polymer longitudinal hood collar of the invention.
Figure 7:
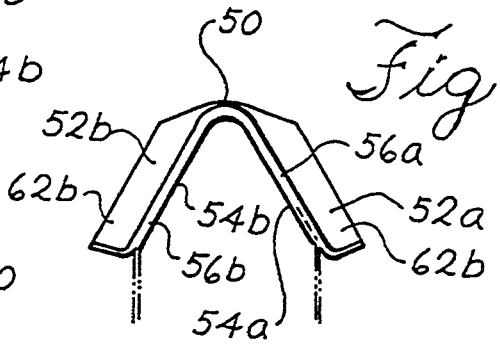
FIG. 7 is a front elevational view of the male portion of the non-metallic polymer longitudinal hood collar of the invention.
Figure 3:
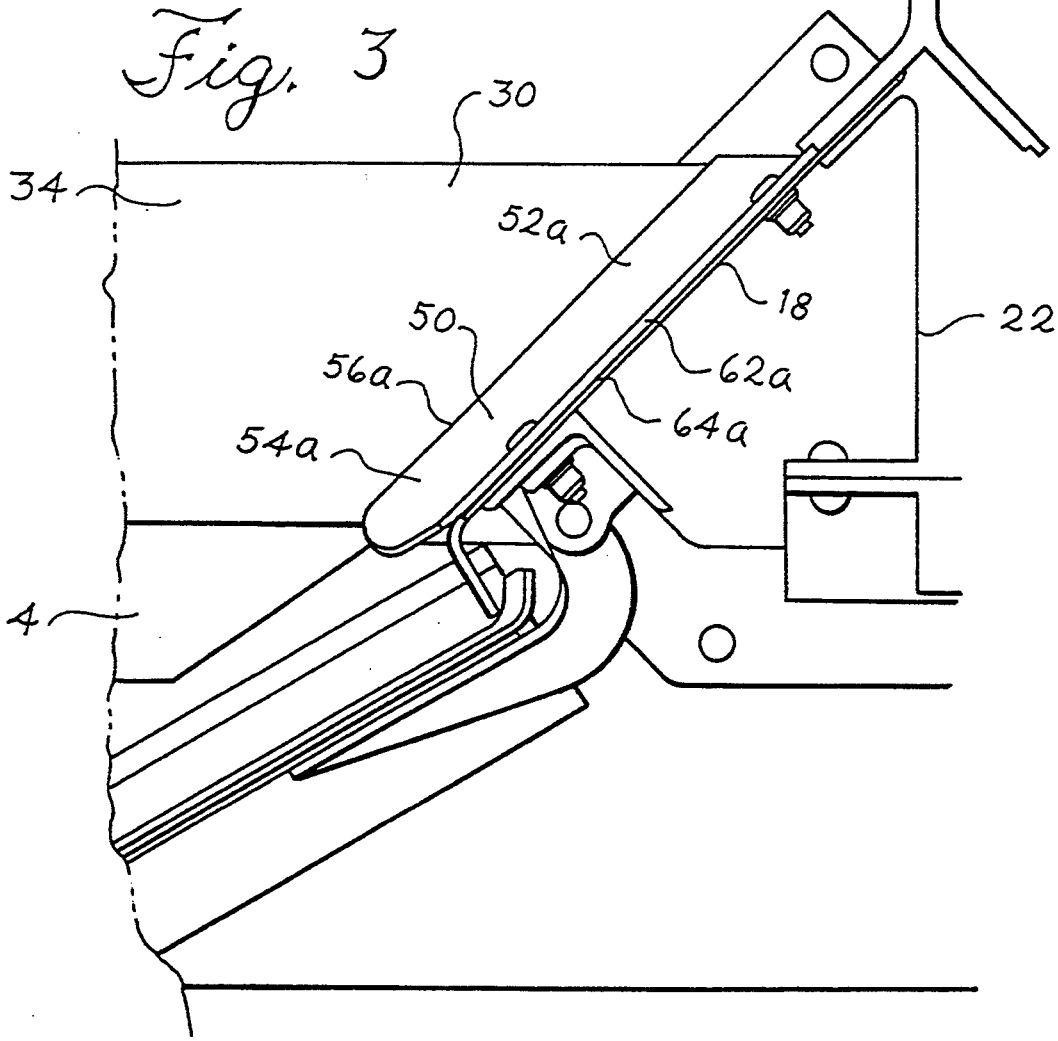
FIG. 3 is a partial side elevational view, with parts in section, of the hopper car of FIG. 1.
Figure 8:
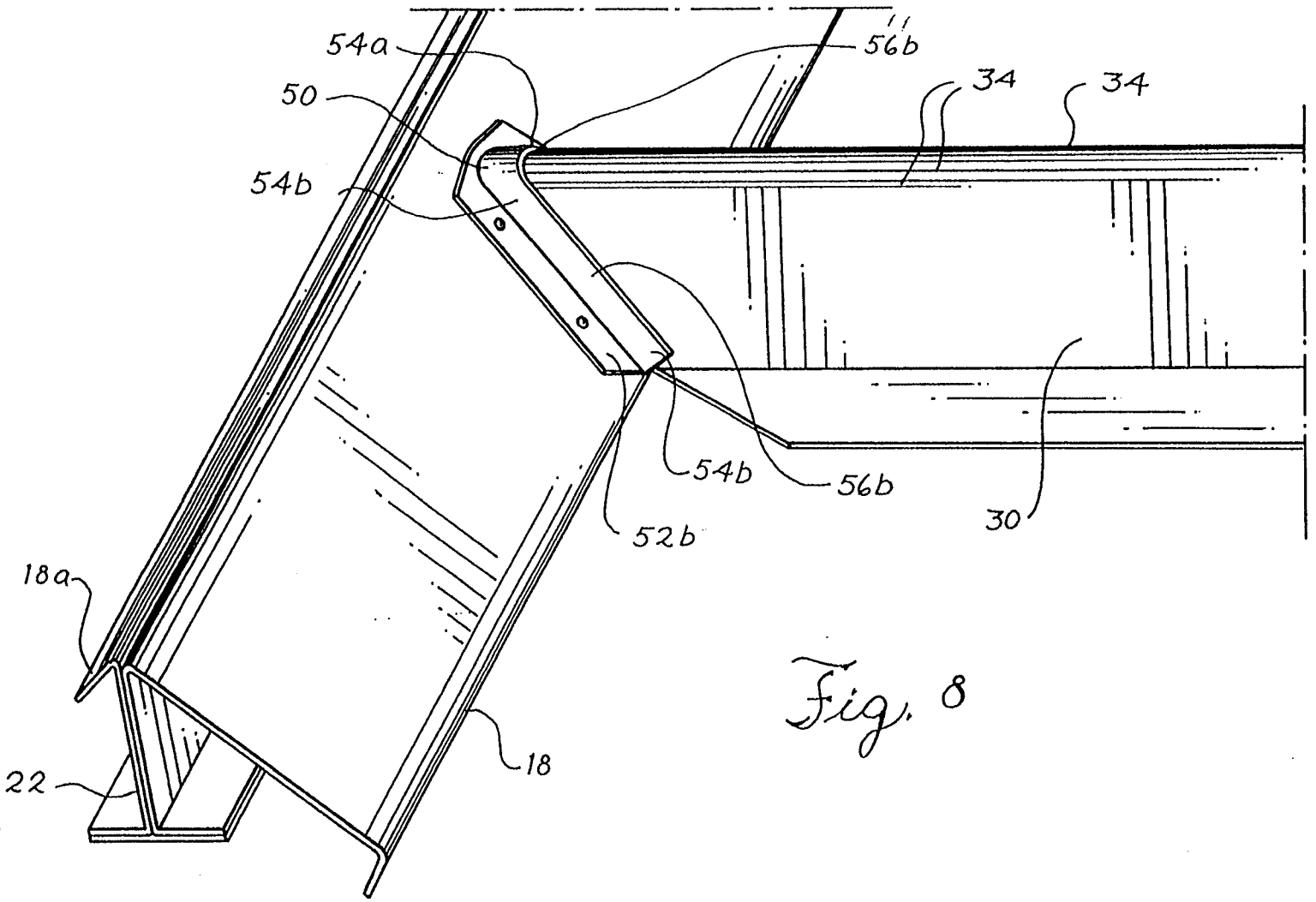
FIG. 8 is a front perspective illustration of the collar and hood connection at a sloped floor sheet using the hood collar of FIG. 5.

As seen in FIGS. 1–3 pairs of sloped intermediate floor sheets 18, 18*a* forming a gable are situated above the pivotal gates 14 and extend for attachment at their outer ends to hopper side walls 10. As seen in FIG. 2 the hopper body 6 includes interior support beams 20 and hopper cross ridge beams 22. The sloped pairs of floor sheets 18, 18*a* are affixed to the hopper cross beams 22. The top of the center sill 4 is protected by a longitudinal extending sill hoods 30 having parallel lower sides 32 and sloped upper sides 34 forming a gable to better control the discharge of lading. The hoods 30 are constructed in either aluminum or steel. The hood 30 serves to cover the center sill 4 and prevent material being transported to contact the center sill and cause corrosion from coal or other lading.

The hoods 30 have a longitudinal axis intersecting floor sheets 18, 18*a* disposed at chute locations. Each hood 30 extends between a sloped floor sheet 18*a* and floor sheet 18 at the adjacent chute location. Hoods 30 also extend at the ends of the car and intersect end sloped walls 12. Because of the various planes of intersection of the longitudinally extending hoods 30 to the sloped sheets 18, 18*a* and the sloped upper portions of hood 30, gaps may exist between the end hood 30 and the sloped surfaces of the sheets 18, 18*a*, which can permit materials being transported to contact the center sill 4.

Referring now to FIGS. 5–8 details of the non-metallic polymer hood collar 50 of the invention are shown. The collar 50 is designed to receive the ends of the longitudinal hood 30 and to seal the intersection of the hood with the sloped lower sheets 18, 18*a* of the hopper car. As seen in FIGS. 4–8, the hood collar 50 of the invention is formed with two angular portions 52*a*, 52*b* symmetrically arranged with respect to each other. The angular portions include flat lower sections 54*a*, 54*b* that angularly extend to correspond to the configuration of the sloped upper surfaces 34 of hood 30. Open ended slots 56*a*, 56*b* are formed on the edge of sections 54*a*, 54*b* to create a female portion to receive the ends of the upper surfaces 34 of the hood. The polymer material forming the collar 50 creates a suitably strong connection, but allows sufficient flexibility to adapt to variations of the configuration of hood 30. In addition, the slots 56*a*, 56*b* provide increased tolerance for variations in the length of the hood 30 during attachment, rather than the more precise accuracy required by prior rigid collars. It should be apparent that the end of the hood 30 is received in slots 56*a*, 56*b*, but the hood 30 is not rigidly affixed to the collar 50.

Each of the angular portions further includes upper flat flange sections 62*a*, 62*b* that angularly flare from lower sections 54*a*, 54*b* and form flat surfaces 64*a*, 64*b* to bear against the intermediate floor sheets 18, 18*a*. The lower sections 54*a*, 54*b* are affixed to the floor sheets 18 by bolted assemblies 66 or similar mechanical fasteners.

What is claimed is:

1. A hopper rail car comprising a car body being supported by truck assemblies at each end, said car body having a longitudinally extending center sill and a hopper for carrying lading, said hopper formed by a pair of side walls and a pair of sloped end walls, said hopper having a plurality of discharge chutes at its bottom, said hopper further having a plurality of sloped floor sheets extending between said side walls at locations adjacent said plurality of discharge chutes, longitudinal hoods covering at least the top portion of said center sill and having ends intersecting said plurality sloped sheets, a collar for creating a connection between one of said ends of said hoods and a sloped floor sheet, said collar receiving said one of said ends of said hoods, said collar further having a section affixed to said sloped floor sheet, and said collar includes a slot, said slot receiving said one of said ends of said hoods.

2. The hopper car according to claim 1 wherein each of said hoods includes a pair of upper sloped surfaces, said slot having a configuration matching said sloped surfaces.

3. The hopper car according to claim 2 wherein said collar includes a pair of lower angularly arranged sections.

4. The hopper car according to claim 3 wherein said angularly arranged sections include edges, said slot being formed in said edges.

5. The hopper car according to claim 3 wherein said collar includes upper angular arranged flanges integrally affixed to said lower sections in angular relationship, said flanges having surfaces for contacting one of said sloped floor sheets.

6. The hopper car according to claim 5 wherein said upper flanges are affixed to said one of said floor sheets by mechanical fasteners.

7. The hopper car according to claim 1 wherein said collar is formed from a flexible material.

8. The hopper car according to claim 7 wherein said flexible material is a polymer.

9. The hopper car according to claim 1 wherein said collar has a modified V-shaped configuration.

10. A hopper rail car comprising a car body being supported by truck assemblies at each end, said car body having a longitudinally extending center sill and a hopper for carrying lading, said hopper formed by a pair of side walls and a pair of end walls, said hopper further having a plurality of sloped floor sheets extending between said side walls, longitudinal hoods covering at least the top portion of said center sill and having free ends terminating adjacent said plurality of sloped sheets, a collar for creating a seal between said one of said free ends of said hoods and a sloped floor sheet, and connection means for directly connecting said collar to one of said free ends of said hoods, said collar further having a section affixed to said sloped floor sheet.

11. The hopper car according to claim 10 wherein each of said connection means includes an opening in said collar, said opening receiving said one of said ends of said hoods.

12. The hopper car according to claim 11 wherein each of said hoods includes a pair of upper sloped surfaces, said opening having a configuration matching said sloped surfaces.

13. The hopper car according to claim 11 wherein said collar is formed from a flexible material.

14. The hopper car according to claim 13 wherein said flexible material is a polymer.

15. The hopper car according to claim 11 wherein said collar includes upper angular arranged flanges integrally affixed to said lower section in angular relationship, said flanges having surfaces for contacting one of said sloped floor sheets.

* * * * *